US006971531B1

(12) United States Patent
Dubach

(10) Patent No.: US 6,971,531 B1
(45) Date of Patent: Dec. 6, 2005

(54) TWO-PART PLASTIC SNAP HINGE CLOSURE

(75) Inventor: Werner Fritz Dubach, Maur (CH)

(73) Assignee: Terxo AG, Wetzikon-Kempten (CH)

( * ) Notice: Subject to any disclaimer, the term of this patent is extended or adjusted under 35 U.S.C. 154(b) by 115 days.

(21) Appl. No.: 10/030,862

(22) PCT Filed: Jun. 29, 2000

(86) PCT No.: PCT/CH00/00351

§ 371 (c)(1),
(2), (4) Date: Jun. 3, 2002

(87) PCT Pub. No.: WO01/04015

PCT Pub. Date: Jan. 18, 2001

(30) Foreign Application Priority Data

Jul. 13, 1999 (CH) ..... 1290/99
Jan. 31, 2000 (CH) ..... 185/00

(51) Int. Cl.[7] ..... B65D 39/08
(52) U.S. Cl. ..... 215/235; 220/827; 220/836; 220/845
(58) Field of Search ..... 215/235, 253–255; 220/827, 836, 837, 845, 829

(56) References Cited

U.S. PATENT DOCUMENTS 4,487,324 A * 12/1984 Ostrowsky ..... 215/253
5,381,920 A 1/1995 Lin
5,386,918 A * 2/1995 Neveras et al. ..... 215/235
5,392,938 A * 2/1995 Dubach ..... 215/254

FOREIGN PATENT DOCUMENTS

| | | |
|---|---|---|
| DE | 37 03 193 | 8/1987 |
| DE | 195 17 102 | 11/1996 |
| EP | 583 204 | 2/1994 |
| EP | 629 560 | 12/1994 |
| JP | 9-301402 | * 11/1997 |
| JP | 9-301403 | * 11/1997 |

* cited by examiner

*Primary Examiner*—Robin A. Hylton
(74) *Attorney, Agent, or Firm*—Pauley Petersen & Erickson

(57) ABSTRACT

A two-part hinge closure having a lower part which has a surrounding outer wall and which can be placed on a container, and has a cap which has an outer wall and which can be joined to the lower part in a hinged manner. The lower part and the cap are separately produced and can be assembled together. In an assembled and closed state, the outer walls are situated above each other in an aligned manner, at least in the hinge area of both hinge closure parts. Both closure parts can be joined to one another by a snap hinge having at least one spring element and at least one coupling piece. When the closure is in a closed state, the at least one spring element and the at least one coupling piece are at least almost aligned with the outer wall of the closure part on which they are formed as one piece.

23 Claims, 4 Drawing Sheets

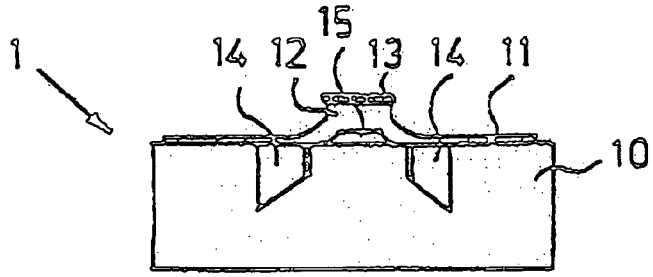
FIG. 1
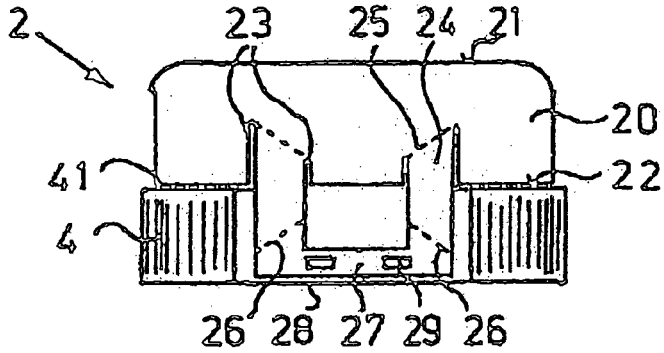
FIG. 2
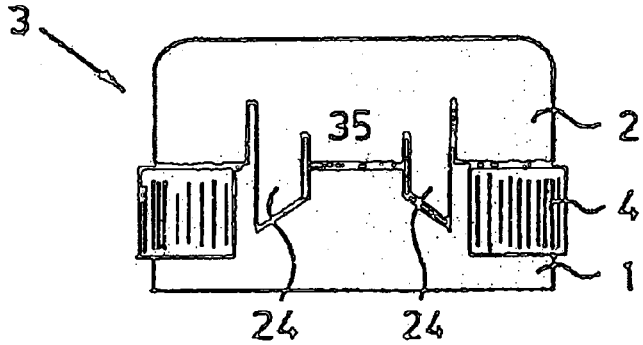
FIG. 3
FIG. 4
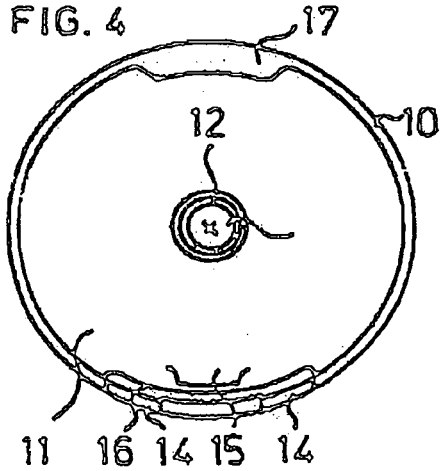
FIG. 5
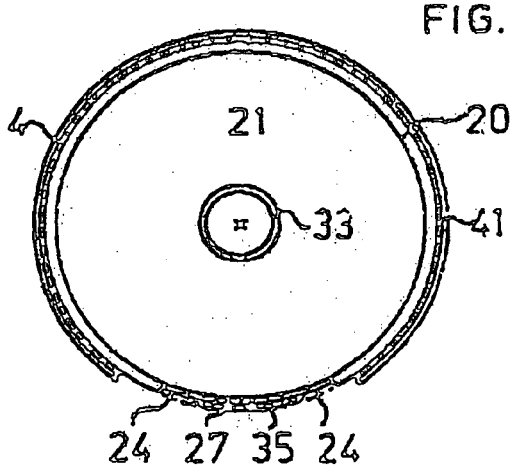

TWO-PART PLASTIC SNAP HINGE CLOSURE

BACKGROUND OF THE INVENTION

1. Field of the Invention

This invention relates to a two-part hinge closure, having a lower part, which can be placed on a container, and having a circumferential casing wall, and a cap, which can be connected with the lower part by a movable hinge and having a casing wall. Both parts are made separately of each other and can be assembled together, and in an assembled, closed state the casing walls of both hinge parts extend flush above each other.

2. Description of Related Art

Hinge closures made of plastic have been on the market for approximately forty years. In the simplest forms, such hinge closures made of plastic consist of a lower part and a cap, wherein the lower part and the cap are connected as one piece by a film hinge. In most cases these are not snap hinge closures. These closures came on the market in large numbers only approximately ten years later. In the meantime the various embodiments of plastic closures with snap hinges overwhelm the entire hinge closure field.

The designs for plastic closures with snap hinges have become more and more complicated. The production of plastic snap hinge closures becomes more and more complex and expensive because of the additional integration of a security strip. The plastic snap hinge closures are a single-piece and usually are loaded from the direction of the lower part during injection molding. The entire material must be pressed from the injection location through the lower part, and thereafter via at least one film hinge into the cap, and the lower part must be loaded. If there is also a security strip, it is necessary to load it with material via very thin connecting points. This leads to the cycle times for injection molding and closing of such plastic parts hardly permitting cycle times below twenty seconds, even with the most modern machinery and optimum design of the injection molds. Also, the respective closures injection-molded in the open state have more problems during ejection. Often the security strips, or also the spring elements which cause the snap action of the snap hinge, become damaged during ejection from the injection mold.

Two-part plastic closures have also been known. Here, the productions as two parts has different reasons, but they are always connected directly or indirectly with the hinge. For example, it is known that the sturdiness of the hinges of single-piece snap hinge closures is relatively low and they tend to tear because of the forces which are introduced in a disadvantageous manner into the film hinges.

Accordingly, it is proposed in European Patent Reference EP-A-0 629 560 to produce the lower part and the cap of a snap hinge closure separately and to manufacture a separate hinge element, with which the two closure parts can be connected with each other, from a rubber-like plastic material.

U.S. Pat. No. 5,381,920 also shows a similar solution, wherein a tool box made of plastic is manufactured from a separate lid and a separate lower part, wherein a pure hinge element can be inserted into appropriate receivers of both parts and thus hingedly connect the two parts.

A single-piece plastic closure is known from German Patent Reference DE-A-195 17 102, wherein the spring element of the snap hinge is separately made. This permits the production of a closure with a spring force of the closure specified by the customer, wherein it is simultaneously possible to work with a considerably simpler injection mold permitting higher cycling times.

True two-part closures are known from German Patent Reference DE-A-37 03 193, as well as European Patent Reference EP-A-0 583 204. In both cases these are not snap hinge closures, but only hinge closures. These closures are made in two pieces because they are relatively large closures, which are intended for long-term use. Accordingly it is desirable, for example, that such closures can also be disassembled again for cleaning, in order to be able to reassemble them later in a clean state for continued use.

SUMMARY OF THE INVENTION

In this regard, this invention has a completely different object. Longevity is of no real interest, but rather the cheapest possible production. Thus it is intended to prevent large amounts of plastic material from having to flow over thin places, for example film hinges.

This object is attained with a two-part design of a hinge closure having characteristics described in this specification and in the claims.

With the two-part design, the amount of plastic per closure part is reduced to approximately half that of a single-piece closure. Thus plastic parts are simplified and reduced and it is possible to operate with much shorter cycle times. In particular, cycle times between four and eight seconds are possible. Also, with the smaller parts it is possible to arrange nearly twice as many cavities per injection mold. The relatively simple and small plastic parts make it also possible to operate with so-called tier tools without any special cost outlay, which multiply the capacity as a function of the number of tiers. This means that with the same plastic injection molding machine it is practically possible to produce approximately three to ten times more two-part plastic hinge closures than single-piece snap hinge closures with the customary technology. Although such a manufacture demands an additional assembly machine, it is known from analogous uses that the capacity of such assembly machines is enormously great. Thus, it is possible to easily process the production capacity from two plastic injection molding machines with one assembly machine and with the technology represented here.

In addition to the purely economic advantages, a plastic closure produced in two parts offers further advantages. The lower part and the upper part can be designed in different colors without problems. Furthermore, the cap and the lower part can also be manufactured from different plastic materials. Thus, it is possible in particular to produce a hinge closure wherein the lower part can be made from PET. It is possible to offer a snap hinge closure for PET containers which is also gas-tight. It is now possible to produce plastic snap hinge closures from PET, for reasons of process technology.

The present trend of continuously falling prices for plastic snap hinge closures practically does not permit the production of individual tools for small runs. On the other hand, customers desire the highest possible degree of customizing. These two requirements are completely opposed. However, with this invention, this problem can be easily solved. The lower part and the cap can be practically combined in the manner of a construction kit. Thus it is possible to produce lower parts of the same diameter and different knurling, and it is possible without a large cost outlay to inject company marks by using interchangeable inserts into the molds for the caps. Also, the already mentioned different color variations, which can be combined with each other in unlimited ways.

With the geometric arrangement of the snap hinge at one of the two closure parts and their special design, it is possible for the injection molds to have the required simplicity, and the corresponding simple assembly can also occur.

This invention also discloses two preferred methods for assembling two embodiments in accordance with this invention.

Further advantageous embodiments of the subject of this invention are determined from the dependent claims and are explained in the following description.

BRIEF DESCRIPTION OF THE DRAWINGS

Embodiments of this invention are represented in the assembled and unassembled states in the attached drawings, wherein:

FIG. 1 shows a lateral view of a lower closure part in an unassembled state, in a direction toward the hinge area;

FIG. 2 shows a lateral view of a matching cap with a security strip, also in an unassembled state;

FIG. 3 shows a lateral view of the two closure parts in an assembled state, viewed in a direction the same as the previously represented individual closure parts;

FIG. 4 shows a top view of the lower closure part shown in FIG. 1, in the unassembled state;

FIG. 5 shows a bottom view of the upper closure part, or the cap, shown in FIG. 2;

DESCRIPTION OF PREFERRED EMBODIMENTS

Figure 6:
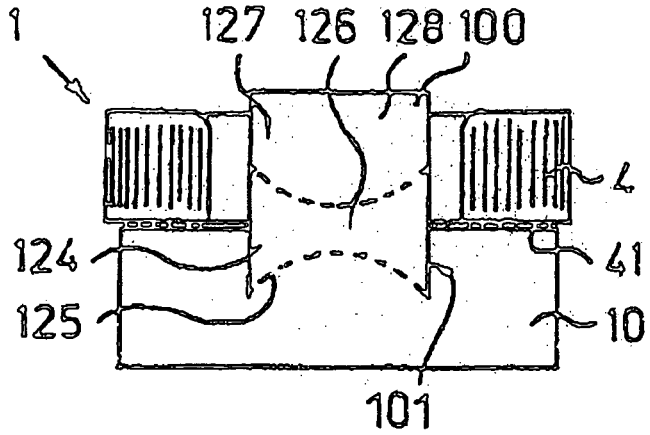
FIG. 6 shows the lower part of a second closure, wherein a spring element and the coupling element are arranged in one piece on a lower part, the same as a security strip.

The closure in accordance with this invention has two individual parts which are separately produced. These are the lower part 1 and the upper part or cap 2. Only in the assembled state do these two closure parts 1, 2 result in the complete closure 3, as shown in FIGS. 3, 8, 13 and 14. For this invention, the presence of casing walls on the lower part 1, as well as on the cap 2, is necessary in order to obtain a closure which is simple to assemble, has no protruding elements and also meets esthetic requirements. Protruding elements are always a problem for entire handling during assembly, as well as for packaging the containers with the corresponding closures. Also, protruding or strongly snapping elements can practically be produced only with appropriate gate valves which make the tools complex and increase the cycling times. Accordingly, only the security strips of the closures in accordance with this invention slightly protrude with respect to the casing walls.

It is generally necessary for all embodiments that the casing walls of both closure parts 1 and 2 be arranged so that they are flush above each other in the assembled state, however, this does not necessarily require that the casing walls extend vertically. It is sufficient for the casing walls of both parts to be flush with each other only in the hinge area, in the assembled state. This is not required in the remaining areas, and thus there is complete freedom of design. In contrast to plastic closures produced in one piece, it is possible without problems, using the technology in accordance with this invention to design closures which as a whole have a conical shape. A further general characteristic of the two-part closures in accordance with this invention is that for all practical purposes the basic arrangement of the parts forming the hinge can be arranged in an arbitrarily interchanged manner. This means that with practically the same embodiment the respective spring elements, or the at least one spring element and the at least one coupling element, can be arranged either in the lower part 1 or on the cap 2, and correspondingly the receivers which are engaged by the parts of the coupling element can be attached to the respectively other closure part. The same concept also applies to the placement of the security strip.

Accordingly, one closure element and another closure element are often mentioned in the following description in order to clarify interchangeability of the terms the lower part and the cap.

A first embodiment is represented in FIGS. 1 to 5. The lower closure part 1 in FIG. 1 has a cylindrical casing wall 10. The lower part 1 has fastening means with which the lower part 1 can be fastened on a container. The fastening means are conventional, for example, a screw thread arranged on the inner wall of the cylindrical casing wall 10, or fastening cams or fastening beads, depending on whether it is intended to screw or press the lower part 1 on a container.

On the top, the lower part 1 is closed off by a cover surface 11, in which a pouring opening or, as in this case a pouring spout 12, is arranged. In a conventional manner, the pouring spout has a circumferential sealing or holding bead 13. Recesses 14 are shown in the lateral view of FIG. 1, which permit the movable spring elements to be free. These cutouts are inwardly offset toward the center in relation to the outer surface of the casing wall 10. The recesses 14 can be offset so far toward the interior that openings are created, which communicate with the interior space of the lower part 1 or, as represented here, are closed by the casing wall. A cam 15 placed on the cover surface 11 is shown, which during the closing process of the assembled closure is used as a stop for the cap edge and thus makes a main hinge between the lower part 1 and the cap 2 superfluous.

The cap 2 matching the lower part 1, as in FIG. 1, is shown in FIG. 2. In this embodiment a security strip 4 is applied by injection molding to the cap 2. The cap 2 has a cover surface 21 adjoined by a circumferential casing wall 20. In the example shown, the casing wall 20 extends vertically with respect to the cover surface 21. However, as already mentioned, the casing wall 20 could also extend inclined with respect to the cover surface 21, so that the entire cap 2 has a conical shape. This would require a corresponding shape of the lower part 1 and its casing walls 10. The security strip 4 is arranged on the lower edge 22 of the cap 2 via strips 41 which act as predetermined breaking points. Slits 23 can be seen, which are oriented upward from the lower cap edge and leave the spring elements 24 free, which are connected in one piece with the cap 2. The transition of the spring elements 24 to the casing wall 20 occurs via film hinges or thin places 25, which here extend obliquely. On their lower end, the two spring elements 24 are connected with each other via a bridge-like coupling element 27. The transition from the coupling element 27 to the two spring elements 24 can also occur via film hinges 26.

Actually, the spring elements 24 are merely parts which transmit tensile forces, wherein the tensile forces result in an elastic bending deformation of adjoining areas of the casing walls 10, 20.

It can be practical for later assembly to extend the coupling element 27 exactly as far downward over the lower cap edge 22 as the lower edge of the security strip 4, so that a circumferential support surface is created for all practical purposes, which is particularly advantageous for handling. Such components do not hang up in assembly devices with shaker conveyors, in particular. Two different fastening means are represented on the coupling element 27, which can be used alternatively or together. For one, a hook-shaped, outwardly directed sharp-edged bead 28 is shown on the lower edge, which can act together with a corresponding groove on the inside of the casing wall 10 of the lower part 1. Also, windows 29 are represented, which can be engaged interlockingly and/or in a frictionally connected manner by cams on the inside of the casing wall 10 of the lower part 1.

A casing wall area 35 which is free remains between the two spring elements 24 and acts together with the cam 15 on the lower part 1. This casing wall area 35, which is free, acts as an one-armed spring lever, which rests against the cam 15. In the completely open state, these two elements are not in engagement with each other, but rather only contact each other during closing and then provide a corresponding restoring force, such as is customary with snap hinges.

As shown in FIG. 3, such a two-part closure provides an esthetically perfect solution which hardly shows that this is not a single-piece closure.

FIG. 4 shows the lower part 1 in a top view. The cover surface 11 with the pouring spout 12 arranged in the center is clearly seen. This view is used in particular to show the arrangements of the cutouts, or openings, into which the coupling element 27, or the spring elements 24, can be pushed. In a radially outward extending direction from the spout 12 arranged in a centered manner, it is possible to first distinguish the cam 15, which is used as a stop for the cap edge during the opening or closing operation, after which an elongated receiving slit 16 is distinguished, which is arranged further outward and extends concentrically in relation to the outer wall. The receiving slit 16 extends through the cover surface 11 and can also be arranged to extend as a depression partially in the inner wall of the lower part 1. The receiving slit 16 communicates with the two laterally arranged recesses 14, in which the spring elements 24, in this case two strap retainers, come to rest in the assembled state. The required free mobility of the spring elements 24 is provided by the adaptation of the shape of the recesses 14. The casing wall 10 of the lower part 1 remains standing between the two recesses 14.

FIG. 5 shows a bottom view of the cap 2. A sealing plug 33 is arranged centered in the cover surface 21 of the cap 2, which can extend sealingly around the pouring spout 12. The security strip 4 extends around the casing wall 20, offset radially outward from the casing wall 20. The connection between the casing wall 20 and the security strip 4 is provided via webs 41. In this view, the coupling element 27 appears to be like a thinned wall area. The normal wall thickness shows the center area 35, which forms the casing wall area as free. The cap 2 again transitions into full wall strength at the end of the spring elements. The outer casing wall line is only shown in dashed lines for clarity in order to show the differences in wall thickness between the casing wall 20 and between the spring elements 24 and the coupling element 26.

A second variation of the two-part plastic closure of this invention is represented in FIGS. 6 to 9. The lower part is identified by element reference numeral 1, the cap by element reference numeral 2 and the entire closure by element reference numeral 3. The element reference numeral 4 is for the security strip, and element reference numeral 41 also means the connecting webs 41 here, with which the security strip is fastened, in this case on the lower part 1.

The lower part 1 in FIG. 6 has a circular-cylindrical casing wall 10. A vertically raised material strip 100 extends flush with this outer surface of the casing wall and comprises a snap hinge 103 having a center area 124, which has a function corresponding to the spring element 24 in the previous embodiment. Here, the transition of this spring element 124 to the lower part 1, or to the casing wall 10 of the lower part 1, occurs by a film hinge 125 extending in an arc. A diametrically opposed film hinge 126 forms a line of separation between the spring element 124 and the coupling element 127. Both film hinges 125 and 126 are shown in dashed lines, because they can hardly be seen in this view. A solution similar to the one represented in the first embodiment can also be used with such a design of the spring element, or the coupling element 124, 127. It is possible to provide the cap 2 with a receiving slit, into which the coupling element 127 can be pushed and wherein a correspondingly shaped recess in the casing wall is provided, which would correspond to the course of the upper film hinge 126.

Figure 7:
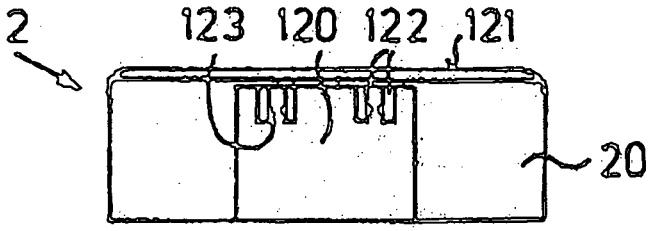
FIG. 7 shows a lateral view of the matching cap, in the same direction as the lower part in FIG. 6.

But a completely different solution is shown here. FIG. 7 shows a cap 2 where the casing wall 20 has a recess 120 which extends over practically the entire height. In its size, the recess 120 corresponds to the material strip 100, so that in the assembled state the material strip 100 can cover the recess 120 exactly in an interlocking manner. On the underside of the cover surface 121 of the cap 2, four support ribs 122, which can have additional interlocking means 123, are formed directly bordering the opening 120. These support ribs 123 are used for receiving two corresponding support ribs 128 between each other in an interlocking or frictionally connected manner.

Figure 8:
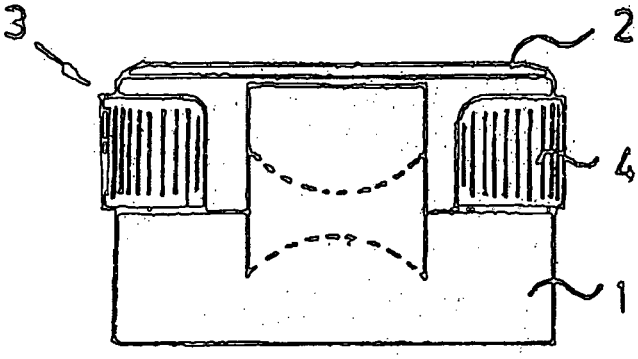
FIG. 8 shows the closure with the two closure parts shown in FIGS. 6 and 7, but in an assembled state.

The assembled entire closure 3 is shown in FIG. 8. This closure is somewhat similar to a conventional single-piece closure. Only the separating lines between the material strip 100 of the casing wall 20 in the cap 2 extend further upward which, for all practical purposes, cannot be detected by a layman. In connection with this embodiment and in contrast to plastic closures produced in one piece, the security strip can also extend not only by approximately 180° around the closure, but for all practical purposes entirely around it, with only a cutout in the area of the hinge.

Figure 9:
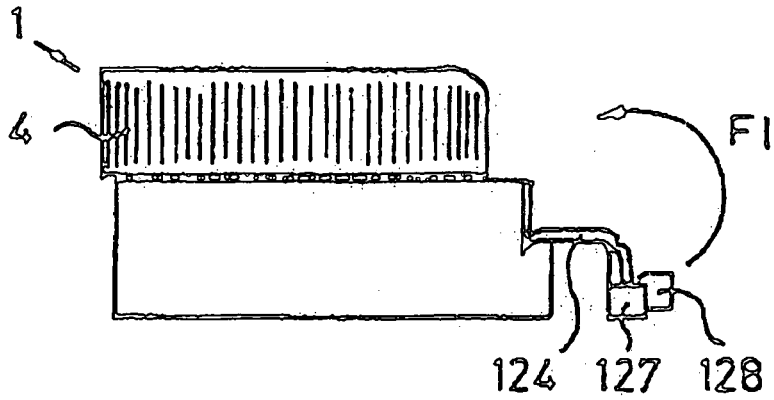
FIG. 9 shows the lower part shown in FIG. 6 but in a lateral view and rotated by 90°, wherein the spring element and the coupling element are shown pivoted downward by practically 180°, which corresponds to a manufacturing position.

The lower part 1 is represented in a lateral view, but rotated by 90° with respect to FIG. 6. In contrast to the previously represented solution, with this embodiment the spring element and the coupling element 124, 127 would not be injected in the vertically extending position as shown in FIG. 6, but in a position as shown in FIG. 9. This provides greater design freedom and also makes it possible to form the support ribs 128 without gate valves in the mold.

In the second embodiment in accordance with FIGS. 6 to 9, no pouring spout is shown. However, the pouring spout can be provided the same as in the previously mentioned embodiment. Accordingly, a corresponding sealing plug can also be provided in the cap 2. However, to include these elements in the drawing would clutter it too much without offering any additional information, but the elements can be provided. This in particular, because these elements play a corresponding part during assembly.

Although the two parts of the closure are individually produced and must be assembled, in comparison to known plastic closures of similar construction they are considerably cheaper because of the enormously increased productivity when manufacturing the individual parts. As previously mentioned, this productivity is the result of the selected shape and the design of the snap hinge closure from two parts.

Figure 10:
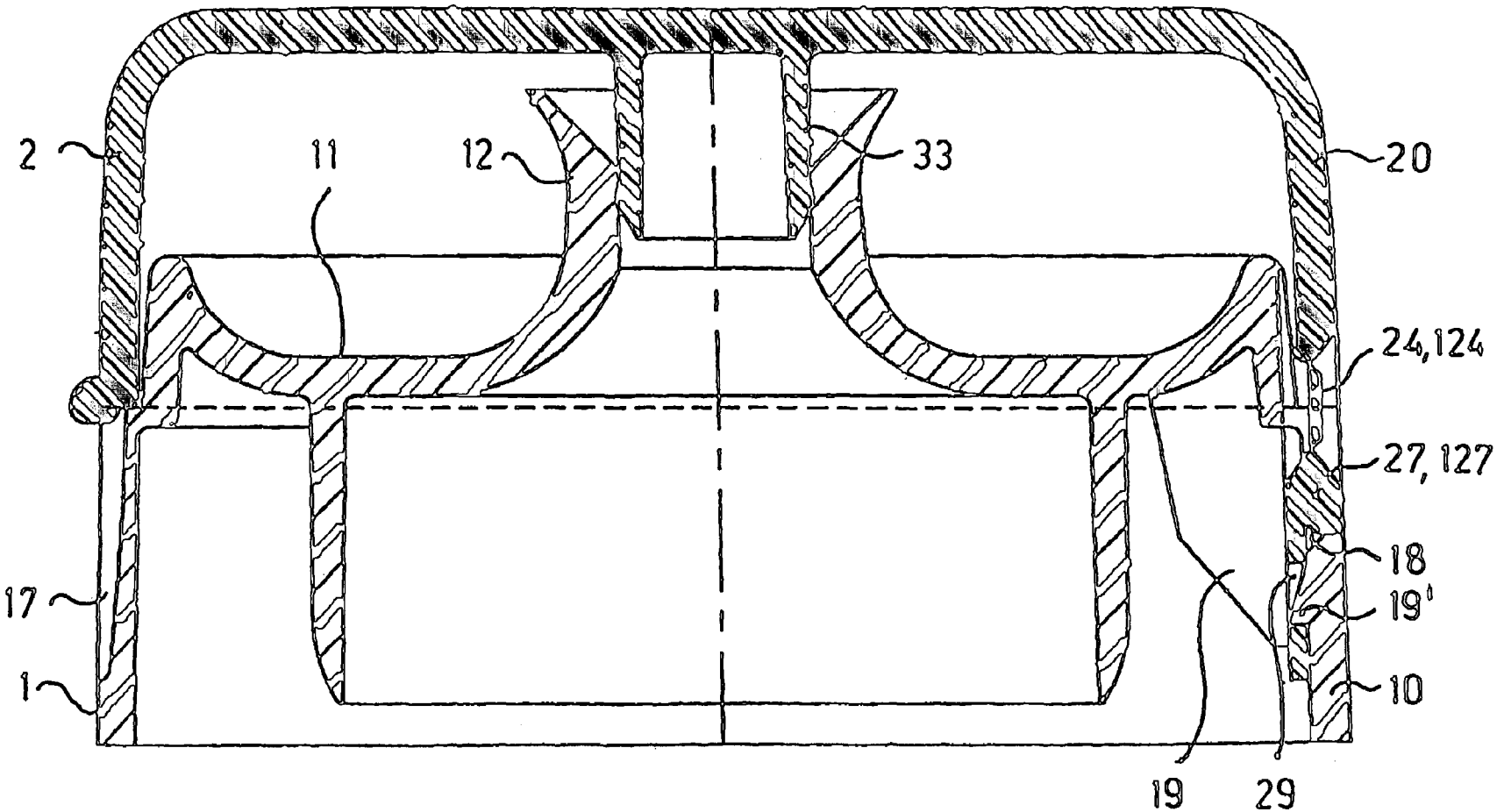
FIG. 10 shows a center vertical section taken through an assembled two-part closure on an enlarged scale.

A solution for a two-part closure 3 which is optimized with respect to production techniques, is represented in FIG. 10 in detail in a centered vertical section. Here, at least one spring element 24 is attached, running in the extension of the casing wall 20 of the cap 2, by at least one film hinge 25. But the coupling element 27 is designed so that it forms at least one part of the casing wall 10 of the lower part 1 and with a centering lip 18 for exact positioning, can be assembled flush.

Moreover, a rib, which is oriented approximately radially outward, is provided as a pressing element 19 in the interior chamber of the lower element 1. The pressing element 19 works together with a retaining projection 19', which extends through at least one window 29 on the coupling element 27. The pressing element 19 makes it impossible to pull the retaining projections 19' out of the window 29, to provide a frictionally connected and interlocking connection between the lower part 1 and the cap 2.

A recessed grip 17 is formed in the casing wall 10 of the lower part 10 opposite the hinge.

A further preferred embodiment of this invention is represented in FIGS. 11 to 14. This embodiment results in a particularly compact solution which is unproblematic in regard to assembly, because the two parts can be plugged vertically together in any arbitrary angle position. This results in a particularly cost-effective assembly, because an appropriate alignment is not necessary and the individual parts have no asymmetrically projecting parts which could lead to a hang-up when manufacturing.

Figure 11:
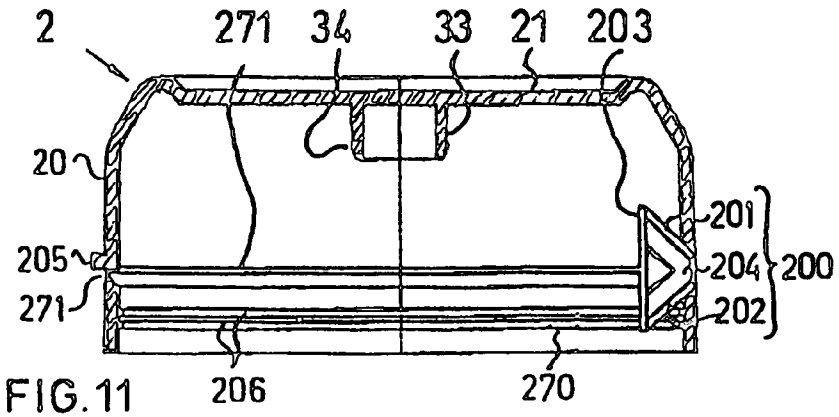
FIG. 11 shows a diametrical vertical section taken through a further embodiment of a cap.
Figure 12:
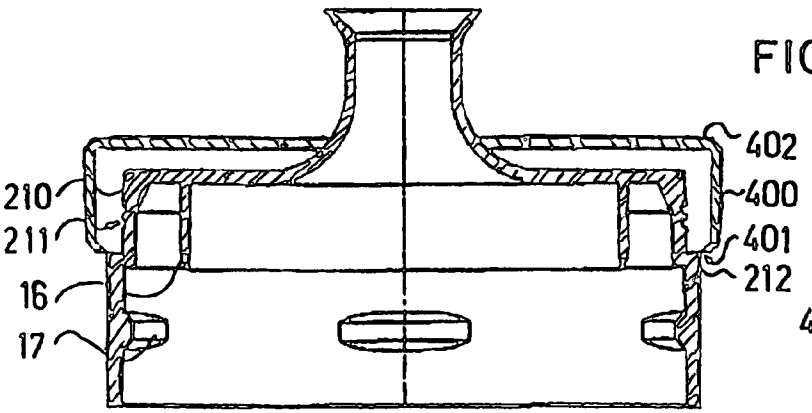
FIG. 12 shows a similar section taken through a lower part matching the cap shown in FIG. 11.

The cap by itself is represented in FIG. 11 in a diametrical vertical section. The cap has a cylindrical casing wall 20 with a spring element 204 designed as a snap hinge. This snap hinge has a film hinge 201 which forms the articulated connection between the spring element 204 and the casing wall 20 of the cap or upper part 2, and a second lower film hinge 202 which forms the articulated connection between the spring element 204 and the coupling element 207 adjoining it on the bottom. Accordingly, the snap hinge 200 is formed by the elements 201, 202 and 204. The snap hinge 200 is bordered in the radial direction by slits 203. The coupling element 270 has a closed ring-shaped form and is connected directly flush under the casing wall 20 with the latter. Here, the coupling element 270 is formed on the casing wall 20 not only by means of the snap hinge 200, but also by a tear seam 217. The tear seam 217 extends from the one lateral border of the snap hinge, extending around it, to the other lateral border 203 of the snap hinge 200 and terminates in the respective slits 203. After cutting the tear seam 217, the coupling element 270 is only connected with the casing wall 20 of the upper part 2 by the spring element 204, the same as in the previously described solutions. The tear seam 217 can be embodied as a continuous thin place or, as known in technology, as a predetermined separating place by using appropriate webs. In the form represented here, the tear seam 271 is represented as a continuous thin place. The lower edge of the casing wall 20 is formed by a pressure bead 205, which projects in an outward direction peripherally circulating. At the first use, the pressure by the user on the pressure bead 205 leads to the severing of the tear seam 271. Two inward projecting retaining beads 206 designed with sharp edges are formed on the inner surface of the circumferential coupling element 270, which are used for the interlocking connection with the embodiment of the lower part 1 represented in FIG. 12. Here, too, the cap 2 has a sealing plug 33, which has a circumferential sealing bead 34.

In this embodiment the lower part 1 also has a circumferential casing wall 10 with an upper area 210 offset toward the interior by approximately the casing wall thickness. Ring-shaped circumferential retaining notches are formed on the exterior surface of the area 21', into which the retaining beads 206 snap in an interlocking manner, in the assembled state of the closure. A security strip 400 is formed on the shoulder 212 formed in the transition area of the casing wall 10 to the inwardly offset upper area 210. The attachment can be embodied as a tear seam 401 or as a predetermined breaking point by using appropriate bridges, which can be cut. The upper edge of the security strip 400 is formed, projecting toward the interior, as a retaining lip 402. The retaining lip 402 is located above the cover surface 21, through which a spout 12 extends. In the closed state, the sealing bead 34 of the previously described sealing plug 33 comes to rest sealingly in the mouth area of the pouring spout 12. An annular wall 16 on the underside of the cover surface 11 is used as a seal against the bottle neck on which the closure is to be placed. A screw thread or, as represented here, a number of holding nubs 17, can be used for fastening on the container neck.

Figure 13:
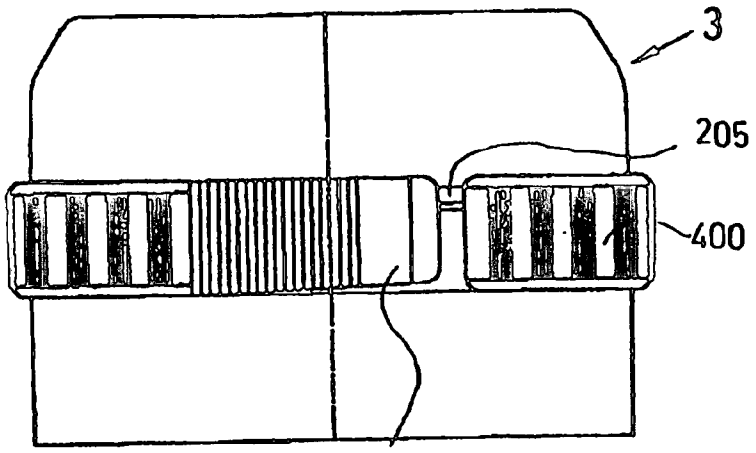
FIG. 13 shows an assembled closure with the lower part and the cap in FIGS. 11 and 12 in a front view.
Figure 14:
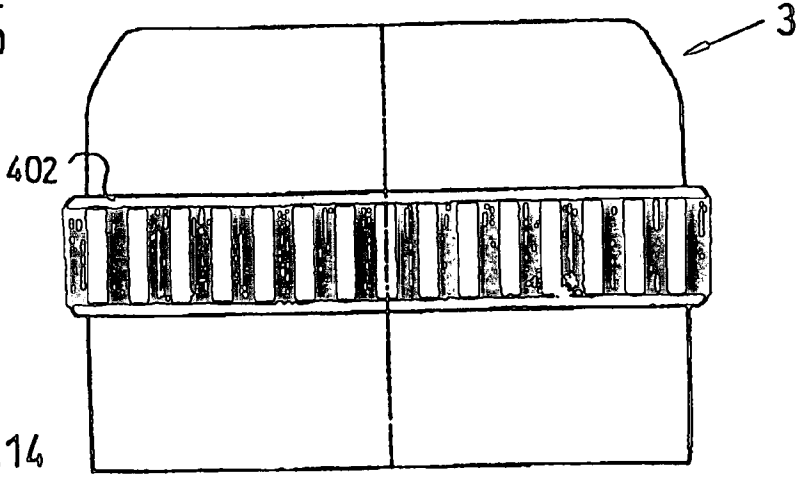
FIG. 14 shows a rear view of the assembled closure as shown in FIG. 13.

The closure 3 is represented assembled in FIGS. 13 and 14. The actual connection between the lower part 1 and the cap, or upper part 2, is practically not visible, because this area is completely covered by the security strip 400. The tongue 403 of the security strip 400 is visible in FIG. 13, while in the position in accordance with FIG. 14, rotated by 180°, the security strip 400 extends continuously. The retaining lip 402 on the security strip 400 covers the pressure bead 205, which is not visible. Only a short section of the pressure bead 205 is shown in the separation area of the tongue 403. The embodiment represented here has many advantages. In regard to production technology and assembly technology it is the version which can be produced best and assembled best. Also, there is a double security feature, because it is necessary prior to the first opening to remove the security strip 400 first, and then to sever the tear seam 271.

LIST OF REFERENCE NUMERALS

1 Lower part
2 Cap
3 Closure
4 Security strip
10 Casing wall
11 Cover surface
12 Pouring spout
13 Retaining bead
14 Recess in the lower part
15 Cam
16 Receiving slit
17 Holding nubs
18 Centering lip

19 Pressing element
19' Retaining projection
20 Casing wall of the cap
21 Cover surface
22 Lower cap edge
23 Slits
24 Spring elements
25 Thin places
26 Film hinge
27 Coupling element
28 Sharp-edged bead
29 Window
33 Sealing peg
34 Sealing bead
35 Casing wall area
41 Connecting webs
100 Stacked material strips
120 Recess
121 Cover surface
122 Support ribs
123 Interlocking means
124 Area as a spring element
125 Film hinge
126 Film hinge
127 Coupling element
128 Support ribs
200 Snap hinge
201 Film hinge
202 Film hinge
203 Slits, lateral border
204 Spring element
205 Pressure bead
206 Retaining beads
210 Upper area of the wall area 10
211 Retaining notches
212 Shoulder
270 Coupling element
271 Tear seam
400 Security strip
401 Tear seam
402 Retaining lip

What is claimed is:

1. In a two-part binge closure (3) having a lower part (1) which can be placed on a container and having a circumferential first casing wall (10), and a cap (2) which can be connected with the lower part (1) by a movable hinge and has a second casing wall (20), wherein the lower part (1) and the cap (2) are made separately of each other and can be assembled together, wherein in an assembled, closed state the first casing wall (10) and the second casing wall (20) extend flush above each other, the improvement comprising: the lower part (1) and the cap (2) connectible with each other by a snap hinge having at least one spring element (24, 124, 204) and at least one coupling element (27, 127, 270), the at least one spring element (24, 124, 204) including a flexible material strip on which the at least one coupling element (27, 127, 270) is formed, the at least one spring element (24, 124, 204) and the at least one coupling element (27, 127, 270) formed in one piece with one of the lower part (1) and the cap (2) and connected in at least one of an interlocking manner and a frictionally connected manner with an other of the lower part (1) and the cap (2), and in the closed state of the closure (3) the at least one spring element (24, 124, 204) and the at least one coupling element (27, 127, 270) being at least approximately flush with the first casing wall (10) and the second casing wall (20).

2. In the two-part hinge closure in accordance with claim 1, wherein the lower part (1) has at least one of a pouring spout (12) and a pouring opening, and the cap (2) has a sealing element (33) which sealingly acts together with the at least one of the pouring spout (12) and the pouring opening in an interlocking manner.

3. In the two-part hinge closure in accordance with claim 1, wherein the at least one spring element comprises two strap retainers (24), wherein ends of the strap retainers (24) project away from one of the lower part (1) and the cap (2) and are connected with each other by the at least one coupling element (27).

4. In the two-part hinge closure in accordance with claim 1, wherein the at least one spring element (124, 204) comprises a snap hinge (101, 200) bordered by two curved film hinges, wherein one of the film hinges (125, 202) forms a first connection with the cap (2) to which the at least one spring element is injection-molded, and an other of the film hinges (126, 204) forms a second connection with the at least one coupling element (127, 270).

5. In the two-part hinge closure in accordance with claim 1, wherein a concentric receiving slit (16) which is offset toward a center of the two-part hinge closure by a thickness of a casing is provided on one of the lower part (1) and the cap (2), in which the at least one coupling element is received in the at least one of an interlocking manner and a frictionally connected manner.

6. In the two-part hinge closure in accordance with claim 5, herein the one of the lower part (1) and the cap (2) with the receiving slit (16) has at least one recess (14) which provides free mobility of the at least one spring element (24, 124) during an opening and closing movement.

7. In the two-part hinge closure in accordance with claim 1 wherein the at least one coupling element (127) which is formed in one piece with one of the lower part (1) and the cap (2) comprises at least one rib (128) connected in a snapped-in fashion with ribs (122) on the other of the lower part (1) and the cap (2).

8. In the two-part hinge closure in accordance with claim 1, wherein a security strip (4) is injection-molded to one of the lower part (1) and the cap (2) on which the at least one spring element (24, 124) and the at least one coupling element (27, 127) are arranged.

9. In the two-part binge closure in accordance with claim 8, wherein the at least one coupling element (27, 127) and the security strip (4) extend at least by a same distance above a casing wall edge of one of the lower part (1) and the cap (2).

10. In the two-part hinge closure in accordance with claim 1, wherein one of the first casing wall (10) and the second casing wall (20) comprises a recess (120) adapted to receive at least a portion of the flexible material of the snap hinge.

11. In the two-part hinge closure in accordance with claim 1, wherein a security strip (4) is arranged on one of the lower part (1) and the cap (2) which extends around as far as a hinge area of the closure.

12. In the two-part hinge closure in accordance with claim 1, wherein a security strip (400) is arranged on the lower part (1) which is free of a spring element (204) and the at least one coupling element (270) and is at least approximately completely circumferential.

13. In the two-part hinge closure in accordance with claim 1, wherein the lower part (1) and the cap (2) are injection molded from at least one of a different plastic material and a different color.

14. In the two-part hinge closure in accordance with claim 13, wherein at least one of the lower part (1) and the cap (2) is made of PET.

15. In the two-part hinge closure in accordance with claim 1, wherein the at least one coupling element (27, 127, 270) in an assembled state forms a part of one of the first casing wall (10) and the second casing wall (20).

16. In the two-part hinge closure in accordance with claim 1, wherein a pressing element (19) is arranged on one of the lower part (1) and the cap (2) which in an assembled state keeps the at least one coupling element (27, 127) frictionally connected with retaining projections (19').

17. In the two-part hinge closure in accordance with claim 4, wherein the at least one spring element (204) is arranged between the cap (2) and a ring-shaped coupling element (270) which is formed flush on the second casing wall (20) by a tear seam (271).

18. In the two-part hinge closure in accordance with claim 17, wherein in an upper area (211) the first casing wall (10) has a shoulder (212) which is offset inward by a thickness of the first casing wall (10).

19. In the two-part hinge closure in accordance with claim 18, wherein a security strip (400) is formed by a predetermined breaking seam (401) in an area of the shoulder (212).

20. In the two-part hinge closure in accordance with claim 18, wherein a second upper area (210) of the second casing wall (20) has retaining notches (211) and the at least one coupling element (270) has retaining beads (206) which interlockingly fit into retaining notches.

21. In the two-part hinge closure in accordance with claim 19, wherein the security strip (400) has a retaining lip (402) which interlockingly extends over a portion of the cap (2).

22. In the two-part binge closure in accordance with claim 21, wherein the cap (2) has a pressure bead (205) on a lower edge of the second casing wall (20) which is interlockingly held by the retaining lip (402).

23. In the two-part hinge closure in accordance with claim 17, wherein a second upper area (210) of the second casing wall (20) has retaining notches (211) and the at least one coupling element (270) has retaining beads (206) which interlockingly fit into retaining notches.

* * * * *